US005330067A

United States Patent [19]

Gronnevik

[11] Patent Number: 5,330,067

[45] Date of Patent: Jul. 19, 1994

[54] COLLAPSIBLE TRANSPORT BOX

[75] Inventor: Oddbjorn Gronnevik, Nesbru, Norway

[73] Assignee: Norsk Hydro a.s., Oslo, Norway

[21] Appl. No.: 927,492

[22] PCT Filed: Feb. 7, 1992

[86] PCT No.: PCT/NO92/00026

§ 371 Date: Sep. 29, 1992

§ 102(e) Date: Sep. 29, 1992

[87] PCT Pub. No.: WO92/13771

PCT Pub. Date: Aug. 20, 1992

[30] Foreign Application Priority Data

Feb. 8, 1991 [NO] Norway ..... 910494

[51] Int. Cl.[5] ..... B65D 7/00

[52] U.S. Cl. ..... 220/7; 220/62; 229/195

[58] Field of Search ..... 220/6, 7, 62; 229/185, 229/195

[56] References Cited

U.S. PATENT DOCUMENTS 696,243 3/1902 Johnston .
1,065,404 6/1913 Helens ..... 220/62
1,072,820 9/1913 Carnes ..... 220/62
1,242,160 10/1917 Eger et al. .
2,916,181 12/1959 Pfister et al. ..... 220/62
3,973,692 8/1976 Cloyde ..... 220/7
4,005,795 2/1977 Mikkelsen et al. ..... 220/62 X
4,091,985 5/1978 Holzinger ..... 229/195
5,114,034 5/1992 Miller et al. ..... 229/195 X

FOREIGN PATENT DOCUMENTS 2163132 2/1986 United Kingdom .

*Primary Examiner*—Steven M. Pollard
*Attorney, Agent, or Firm*—Wenderoth, Lind & Ponack

[57] ABSTRACT

A collapsible transport box is formed from an essentially planar material blank including a bottom and side walls and a lid, as appropriate. The side walls are hinged or otherwise attached to the bottom so as to be foldable relative to the bottom. The walls are joined at the box corners by releasable connections, each of which includes a vertical slot or hole in a first side wall and an outward extending fastening tongue on an end edge of a second side wall. The fastening tongue extends through the slot and is bent sideways so that its external section extends over an external region of the first side wall.

5 Claims, 3 Drawing Sheets

COLLAPSIBLE TRANSPORT BOX

BACKGROUND OF THE INVENTION

The present invention relates to a collapsible box formed from a generally planar material comprising a bottom and side walls and including a lid if desired, wherein the side walls are hinged or otherwise connected to the bottom such that they can be folded relative to the bottom, and wherein the corners of the box are joined by means of releasable connections.

Known in the art are collapsible boxes of this general type. One example is disclosed in DE Patent Application No. 3,444,477 of a box having a shape amenable to a tongue and groove design in which an end edge of one side extends into a groove on the opposite side of each of the box corners. The end edge is retained in the groove by the action of projections which correspond to depressions in the groove. This design is mechanically weak and will not survive serious impacts. Furthermore, it is difficult to assemble since the projections must be pressed past the "opening" in the groove.

DE Patent Application No. 3,046,954 shows another collapsible transport box in which the corner connection includes hook-shaped latches which extend from the end edge of one side wall into grooves in the other side wall. This design is also mechanically weak, since the latch hooks will yield to loads and will be pulled out of the grooves. Also, the latches are in an exposed position and can be released from the grooves by inept handling of the box.

SUMMARY OF THE INVENTION

The present invention provides a collapsible transport box of the above type, but wherein the connections between the sides at the corners of the box are of a simple design and also inexpensive to produce. Further, the connection of the invention is mechanically strong and cannot be released by unfortunate handling of the box.

The invention is characterized in that the joint between the side walls at each of the corners of the box comprises a vertical slot or opening which is provided in a first side wall, and an extended fastening tongue at an end edge of the other side wall and which extends through the slot and is bent sideways so as to extend outwardly along an external part of the first side wall.

BRIEF DESCRIPTION OF THE DRAWINGS

The invention will now be described in more detail by means of examples and with reference to the accompanying drawings in which.

DETAILED DESCRIPTION OF THE INVENTION

Figure 1:
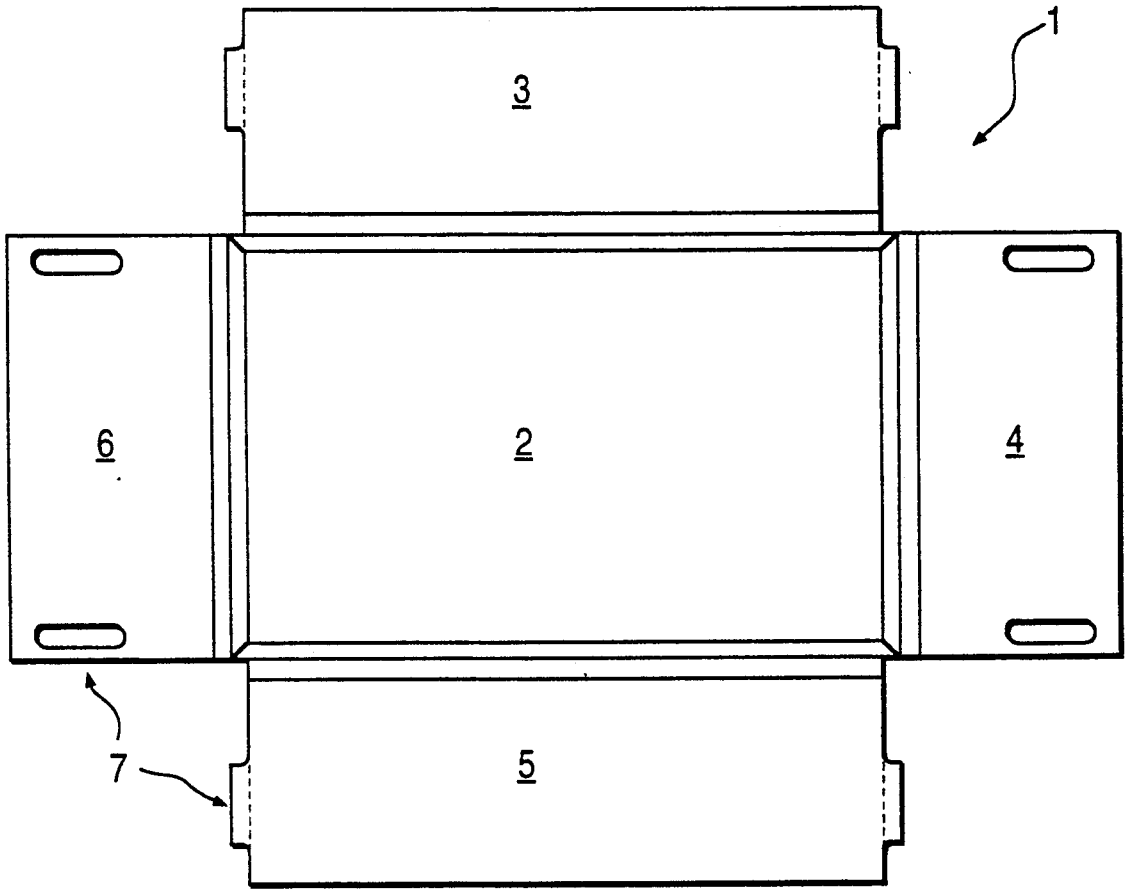
FIG. 1 is a plan view of a material blank from which a box according to the invention is formed.

FIG. 1 depicts a material blank 1 from which the box according to the invention is fabricated. The blank comprises a bottom section 2 and four side sections 3–6 which are hinged or otherwise joined to the bottom section 2. The material blank can if appropriate be fabricated from a double-walled hollow body of thermoplastic material as further described and shown in Norwegian Patent No. 162,335, though it can also be a single-wall design and be made of basically any suitable material.

Figure 2:
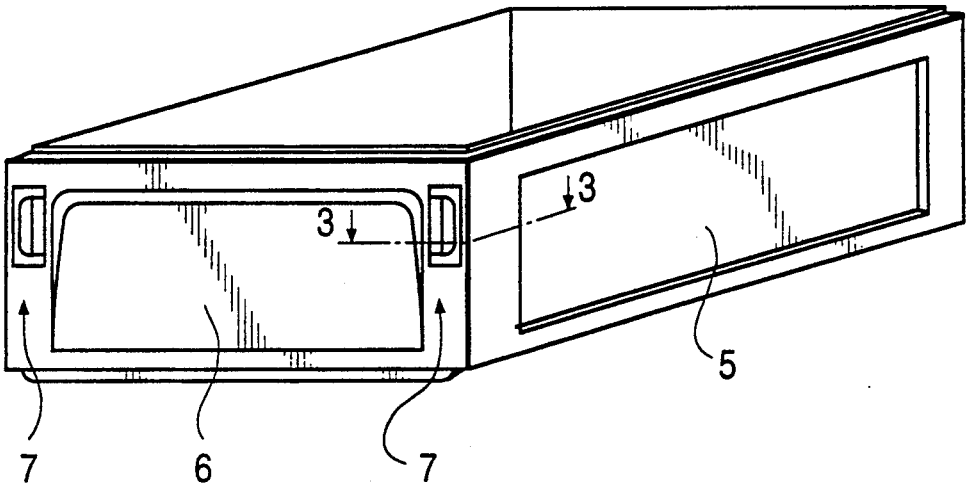
FIG. 2 is a perspective view of a box formed from the material blank shown in FIG. 1.

FIG. 2 depicts a box formed from the material bank of FIG. 1. The walls at the box corners are joined by means of releasable connections 7, described in further detail with reference to FIGS. 3 and 4.

Figure 3:
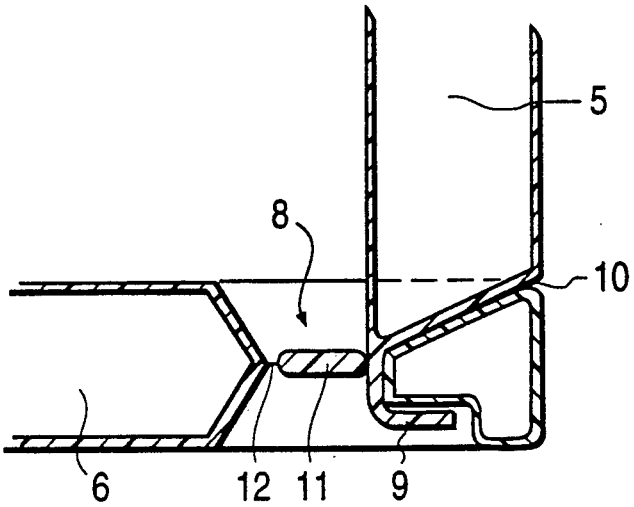
FIG. 3 is a horizontal section, on an enlarged scale, through a corner of the box shown in FIG. 2, taken along line 3—3.
Figure 4:
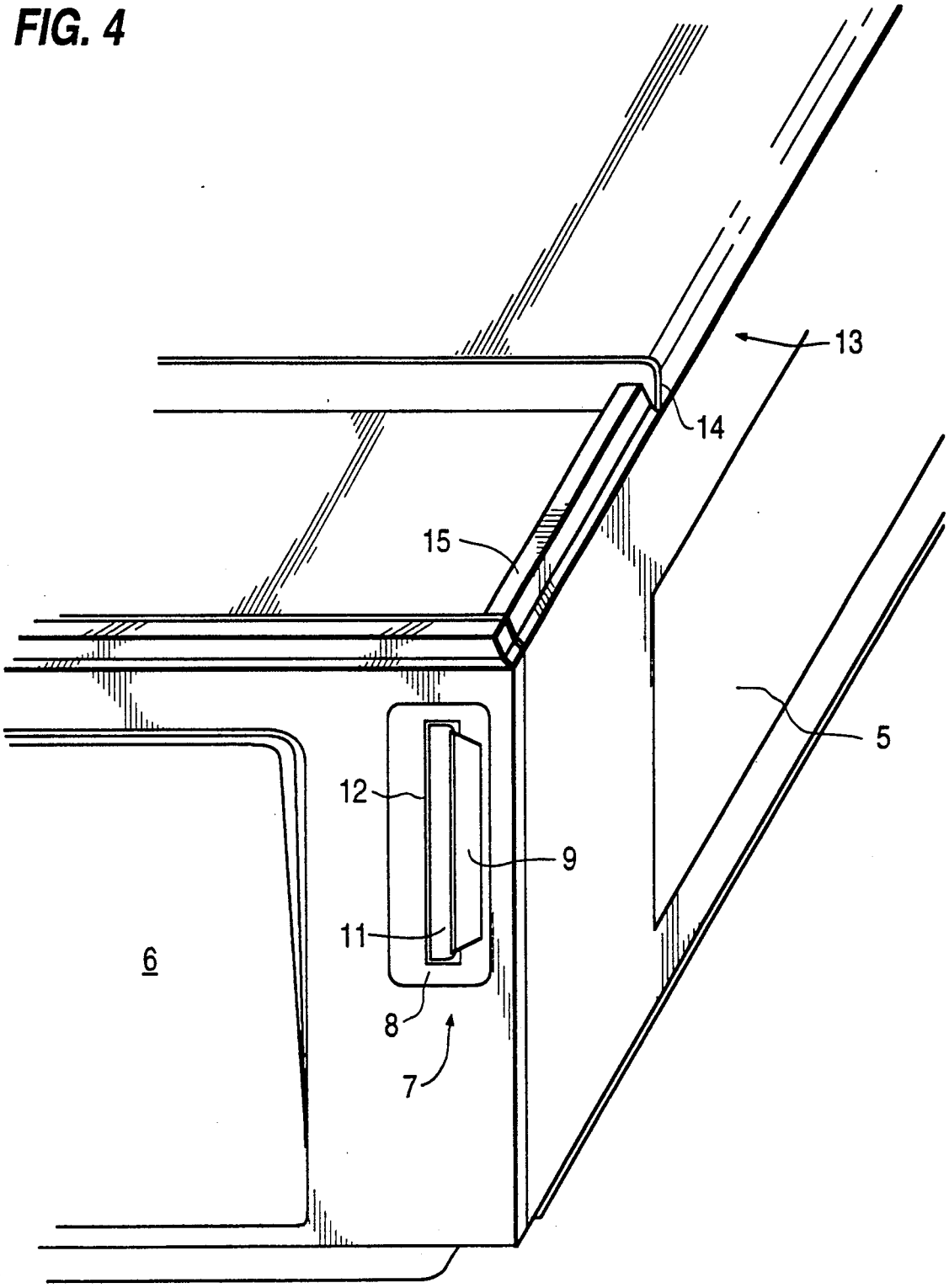
FIG. 4 is a perspective view, on an enlarged scale, of a corner of the box shown in FIG. 2.

As will be understood from FIGS. 3 and 4, one of the side walls 6 is provided with a vertical slot or opening 8 while the other side wall 5 at its end is provided with an outwardly extending fastening tongue 9. The fastening tongue 9 extends through the slot 8, from inwardly of the box to outwardly thereof, and is bent sideways so as to extend over an external part of the other side wall 6. An end edge 10 of the side wall 5 is of bevelled shape and rests against a complementary, bevelled part of the opposite side wall 6. A locking wedge 11 retains the fastening tongue 9 in the slot 8. The locking wedge is "hinged" to the opening 8 via a thin material connection in the region 12 as indicated in FIGS. 3 and 4 and is kept in its locking position as shown in FIG. 3 by means of a small vertical groove in or elevated ribs on the tongue 9 opposite the end of the wedge (not further shown). The wedge 11 is used to prevent slack from developing in the corner connection and to avoid the fastening tongue from being withdrawn from the slot. This is particularly useful when the box is empty. As soon as a payload is filled into the box and the sides are pressed outwardly, the fastening tongue will be forced against the edge of the slot and will be self-locking.

As is apparent from FIG. 4, the box may preferably be provided with a lid 13. The lid may be hinged to one of the side walls or be attached releasably. The lid is provided with a downward edge 14 which extends outside an upward edge 15 on the box. Thus, there is achieved a strength enhancement of the box when the lid is in place since the side walls are held in place within the edge of the lid.

The present invention provides a simple, collapsible box which is inexpensive to manufacture and simple to use and which, depending on the material from which it is made, can be used many times. It should be emphasized that the term "box" is not limited to containers for transport purposes. Thus, the present invention may be applied on any construction having a bottom or back with sides or side walls, for instance a bookshelf. In the case of a bookshelf, the selves as such may be connected to the side walls by means of the same tongue and slot principle as defined above regarding the corner connections.

I claim:

1. In a collapsible box formed of a generally planar material blank including a bottom and side walls hinged or otherwise connected to said bottom to be foldable relative thereto to a folded position whereat adjacent edges of adjacent pairs of said walls form respective corners of said box, and releasable connections joining said adjacent pairs of walls of respective said corners, the improvement wherein each said releasable connection comprises:

a vertical slot formed in a first said wall;

a fastening tongue projecting from said edge of a second said wall;

said tongue extending through said slot in a direction from inwardly to outwardly of said box; and a portion of said tongue projecting outwardly of said slot being bent laterally and extending across an external portion of said first wall.

2. The improvement claimed in claim 1, further comprising a locking wedge in said slot and pressing said tongue against an edge of said first wall defining said slot.

3. The improvement claimed in claim 2, wherein said locking wedge is removably attached in said slot.

4. The improvement claimed in claim 2, wherein said locking wedge is hinged by a thin material section to an edge of said first wall defining said slot to be pivotable laterally thereof upon insertion of said tongue into said slot.

5. The improvement claimed in claim 1, further comprising a box lid having a downwardly extending portion fitting outwardly of upwardly extending portions of said walls.

* * * * *